US005646601A

United States Patent [19]

Wallace et al.

[11] Patent Number: 5,646,601

[45] Date of Patent: Jul. 8, 1997

[54] MAGNETIC APPARATUS FOR ACTUATING A REED SWITCH AND ASSOCIATED SYSTEM

[75] Inventors: Richard H. Wallace, Plano; Robert W. Pospick, Dallas, both of Tex.

[73] Assignee: Texas Instruments Incorporated, Dallas, Tex.

[21] Appl. No.: 243,060

[22] Filed: May 16, 1994

Related U.S. Application Data

[63] Continuation of Ser. No. 864,840, Apr. 7, 1992, abandoned.

[51] Int. Cl.[6] ..... G08B 21/00

[52] U.S. Cl. ..... 340/686; 335/205; 340/692; 340/693; 434/168; 446/397

[58] Field of Search ..... 340/686, 689, 340/669, 692, 693; 200/61.45 M, 61.53; 335/205–7; 33/366, 365; 338/32 H, 32 R; 324/207.13, 207.2, 207.21; 73/517 R, 519; 434/168; 446/397, 484; 901/46

[56] References Cited

U.S. PATENT DOCUMENTS

| | | | |
|---|---|---|---|
| 4,041,427 | 8/1977 | Chusha | 335/205 |
| 4,275,391 | 6/1981 | Okamura | 340/689 X |
| 4,395,695 | 7/1983 | Nakamura | 338/32 H |
| 4,553,134 | 11/1985 | Holt | 340/689 X |
| 4,620,173 | 10/1986 | O'Brien | 335/205 |
| 4,697,174 | 9/1987 | Viator, Sr. | 340/689 |
| 4,701,146 | 10/1987 | Swenson | 446/130 |
| 4,809,191 | 2/1989 | Domeier et al. | 901/46 X |
| 4,864,288 | 9/1989 | Cross | 340/669 |
| 4,957,291 | 9/1990 | Miffitt et al. | 273/153 R |
| 5,325,078 | 6/1994 | Carothers | 335/205 |

FOREIGN PATENT DOCUMENTS

| | | | |
|---|---|---|---|
| 247102 | 6/1987 | Germany | 335/205 |
| 1436079 | 11/1988 | U.S.S.R. | 340/690 |

*Primary Examiner*—Brent Swarthout
*Assistant Examiner*—Thomas J. Mullen, Jr.
*Attorney, Agent, or Firm*—Ira S. Matsil; James C. Kesterson; Richard L. Donaldson

[57] ABSTRACT

A magnetic apparatus (10) is provided having a bottom plate (12), a top plate (14), a first magnet guide (16), a second magnet guide (18) and a magnet member (20) which is slidable upon a slide axis (22) through apertures (40) and (54) of first magnet guide (16) and second magnet guide (18) respectively. The magnetic apparatus (10) is shown in a closed position in FIG. 1 for use in conjunction with a reed switch (86) (see FIG. 3) mounted on bottom plate (12). In the closed position magnet member (20) is close enough to the reed switch (86) to magnetically toggle reed switch (86) and thus electrically toggle electrical circuit (100). When the magnetic apparatus (10) is moved in three-dimensional space so that reference plane (24) is changed with respect to gravity line (26) to a sufficient degree, then magnet member (20) will shift along slide axis (22) toward second magnet guide (18). Thus, magnet member (20) shifts from the closed position, as shown, to an open position where the magnet member (20) is shifted to the right (see FIG. 2). Magnet member (20) is weighted so as to provide more efficacious shifting yet with a smaller scale of elements for magnetic apparatus (10). Apertures (40), (54) provide open shifting of magnet member (20) as opposed to an enclosed compartment for shifting of magnet member (20), thereby averting problems of contamination and accumulated moisture content. In the preferred embodiment, five magnetic apparatuses (10) are combined in an array (84) (see FIG. 3) to provide a combination of thirty-two possible gravitational orientations, thus allowing an extremely gravitationally sensitive array which can be used in a system (110) (see FIG. 10) requiring a gravitation-detection component.

25 Claims, 5 Drawing Sheets

MAGNETIC APPARATUS FOR ACTUATING A REED SWITCH AND ASSOCIATED SYSTEM

CROSS-REFERENCE TO RELATED APPLICATIONS

This application is a Continuation, of application Ser. No. 07/864,840, filed Apr. 7, 1992, abandoned.

U.S. patent application Ser. No. 759,192, filed Sep. 10, 1991 as a continuation of U.S. application Ser. No. 309,451, filed Feb. 10, 1989, now abandoned, is incorporated herein by reference and is a related application, as is U.S. patent application Ser. No. 706,617 filed May 29, 1991 and now U.S. Pat. No. 5,168,138.

BACKGROUND OF THE INVENTION

1. Field of the Invention

This invention relates to gravity-sensitive switches used in electrical systems. More particularly, it relates to a gravity-sensitive switch featuring a shiftable magnet.

2. Description of the Prior Art

Gravity-sensitive switches employing conductive rolling balls, optical detectors utilized with shifting apparatus, mercury switches and the like have long been used for various purposes.

Switches utilizing magnets are preferable to mercury switches for environmental and safety reasons, as well as for simplicity of design. Magnets used in conjunction with reed switches, however, tend to be bulky because of the magnet size required to effectively overcome the coefficient of friction (i.e. the weight and corresponding size of the magnet must be such that the device is gravitationally sensitive). The size of the magnet can in turn cause unwanted magnetic side effects in the operation of the mechanism. The magnets used in these gravity-sensitive apparatus are also typically completely enclosed. The enclosure aspect of the apparatus leads to undesirable moisture and contamination problems within the casing housing the magnet.

What is needed is a magnetic apparatus (suitable for use with a reed switch or the like) which is relatively small yet gravitationally sensitive. Also needed is an apparatus wherein the magnet is not completely enclosed so that moisture and contamination problems are avoided.

SUMMARY OF THE INVENTION

The problems outlined above are in large measure solved by the apparatus and corresponding system in accordance with the present invention. That is to say the invention hereof provides a design for actuating a reed switch, featuring a magnetic apparatus which is relatively small yet gravitationally sensitive and further wherein the magnetic apparatus is not completely enclosed.

The magnetic apparatus includes a bottom plate presenting a gravity reference plane, a first magnet guide, a second magnet guide and a magnet member. The first magnet guide has a first aperture and the second magnet guide has a second aperture. The magnet member includes a magnet shiftable along a slide axis running through the first and second apertures. Thus the magnet is shiftable along the slide axis between a closed position and an open position depending on the orientation of the gravity reference plane of the bottom plate. In preferred embodiments, a weight is secured to the magnet, and the magnet member includes a stopping member for stopping the magnet respectively in the closed or open position, depending on the orientation of the gravity reference plane.

The above-described magnetic apparatus can be combined with a reed switch to form a magnetic assembly. An array of such assemblies can be used in conjunction with a system having a frame and an electrical circuit including logic structure such that depending on the gravitational orientation of the frame, the logic structure generates a signal corresponding to that gravitational orientation. The signal can be used to generate a word, for example, or other response appropriate to the system. In this fashion the system is gravitationally sensitive and can have a variety of predetermined responses appropriate depending on gravitational orientation.

DETAILED DESCRIPTION OF THE PREFERRED EMBODIMENT

Figure 1:
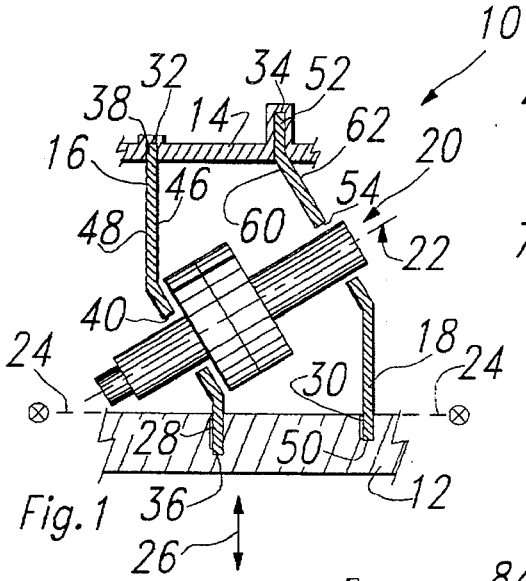
FIG. 1 is a partial sectional view of a magnetic apparatus in the closed position in accordance with the present invention.

Referring now to the drawing in general and FIG. 1 in particular, a magnetic apparatus 10 is partially, cross-sectionally shown (with cross-sectional hatchings omitted for clarity of illustration). Magnetic apparatus 10 includes a bottom plate 12, a top plate 14, a first magnet guide 16, a second magnet guide 18 and a magnet member 20. Magnet member 20 is shiftable along a slide axis 22 between a closed position (as shown) and an open position (see FIG. 2). Shifting of magnet member 20 between the closed position and the open position or vice versa is designed to result in toggling a circuit element such as a reed switch or the like, as discussed in detail later on.

Bottom plate 12 is a printed wire board (PWB) in the preferred embodiment but alternatively can be a nonconductive material with a printed wire board mounted thereon. Bottom plate 12 presents a gravity reference plane 24

(perpendicular to the plane of the page as shown in FIG. 1). Gravity reference plane 24 is oriented with respect to a gravity line 26 such that magnet member 20 is in the closed position. Gravity line 26 is defined as a line from the center of the earth to a point on the surface on the earth located directly below magnetic apparatus 10. Essentially, gravity line 26 is the line along which the force of gravity acts on apparatus 10.

Figure 3:
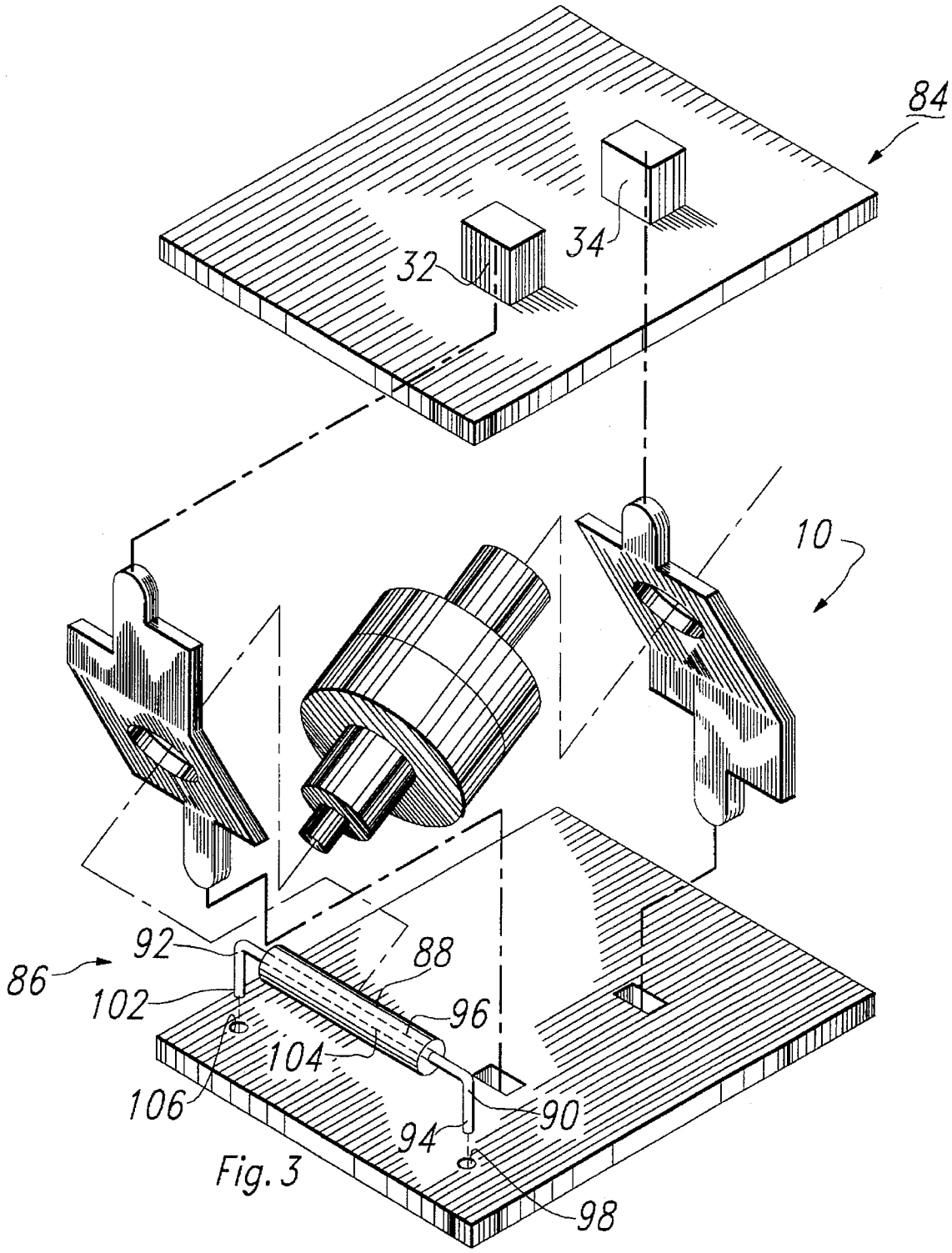
FIG. 3 is an exploded view of the magnetic apparatus of FIGS. 1 and 2 in conjunction with a reed switch.
Figure 4:
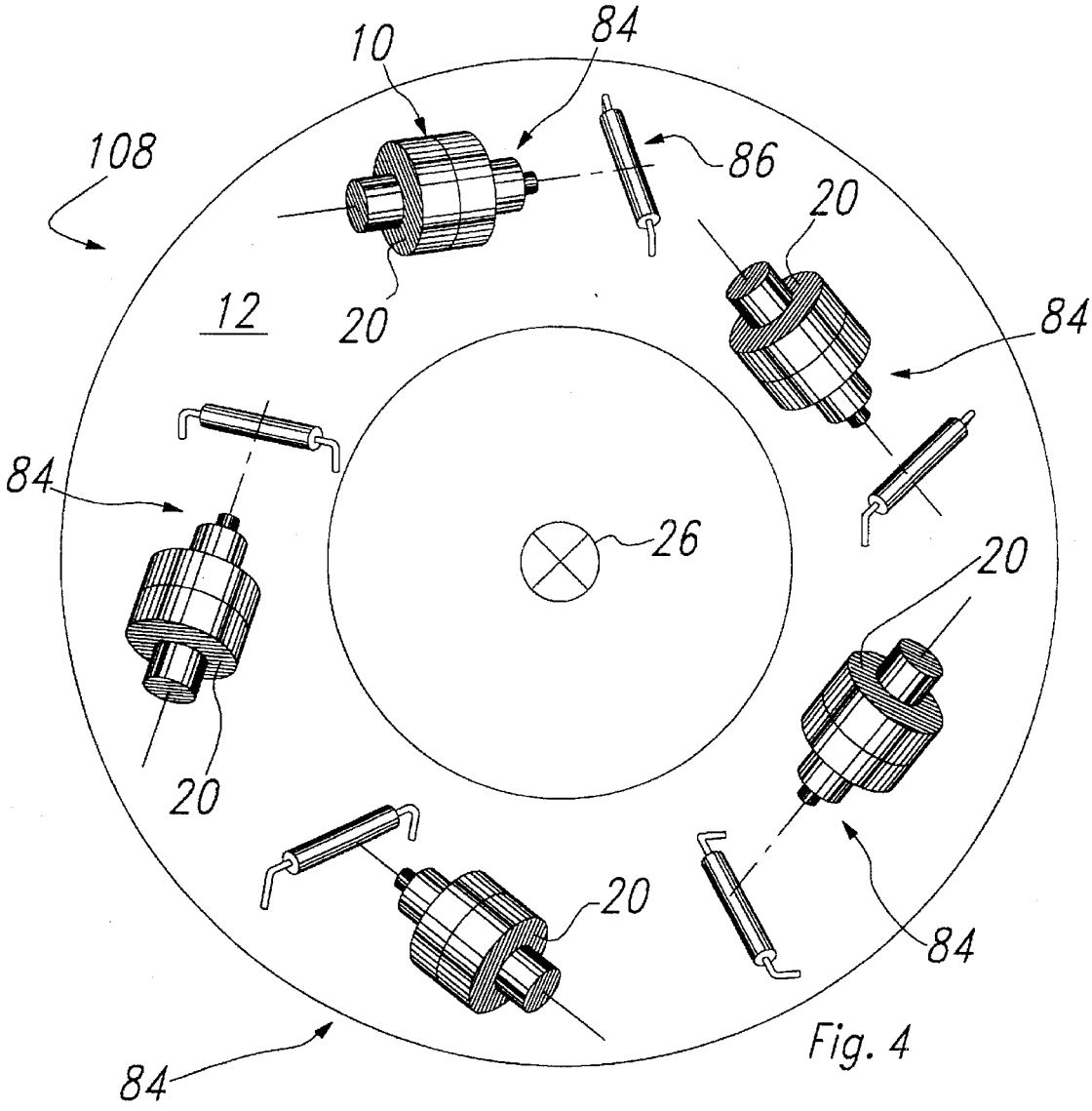
FIG. 4 is a plan view of an array of five assemblies, each assembly including a magnetic apparatus in conjunction with a reed switch.

Bottom plate 12 can have a size suited for an individual apparatus 10 (as in FIG. 3), or can be larger and have many magnet members 20 associated therewith (as shown in FIG. 4).

Still referring to FIG. 1, bottom plate 12 also includes a first bottom slot 28 and a second bottom slot 30.

Top plate 14 is made of a nonconductive material, preferably a synthetic resin material. A first top slot 32 and a second top slot 34 are formed in top plate 14 (see also FIG. 3).

Figure 5:
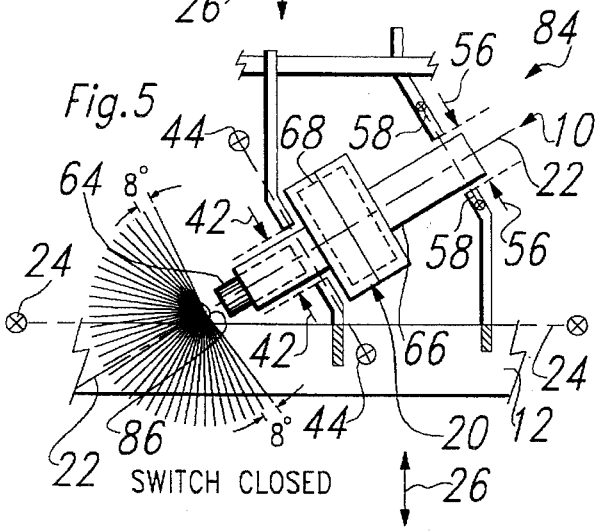
FIG. 5 is a partial sectional view of the assembly of FIG. 3 depicting a substantially semispherical range of angles over which the magnetic apparatus is in a closed position.

First magnet guide 16 is made of a nonconductive material, preferably a synthetic resin. First magnet guide 16 has a first bottom tab 36, matingly received in first bottom slot 28, and a top tab 38 matingly received in first top slot 32. First magnet guide 16 includes a first aperture 40 presenting a first aperture diameter 42 (see FIG. 5) and a first aperture plane 44 (see FIG. 5), which is perpendicular to the plane of the page (as shown in FIG. 5). First magnet guide 16 also presents an inside surface 46 and an outside surface 48. First magnet guide 16 is supported by bottom plate 12 in an upright position such that first aperture plane 44 defines an oblique angle with respect to gravity reference plane 24.

Still referring to FIG. 1, second magnet guide 18 is made of a nonconductive material, preferably a synthetic resin. Second magnet guide 18 has a second bottom tab 50 matingly received in second bottom slot 30, and a second top tab 52 matingly received in second top slot 34. Second magnet guide 18 includes a second aperture 54 presenting a second aperture diameter 56 (see FIG. 5) and a second aperture plane 58 (see FIG. 5), which is perpendicular to the plane of the page (as shown in FIG. 5). Second magnet guide 18 also presents an inside surface 60 and an outside surface 62. Second magnet guide 18 is supported by bottom plate 12 in an upright position such that second aperture plane 58 defines an oblique angle with respect to gravity reference plane 24.

Figure 2:
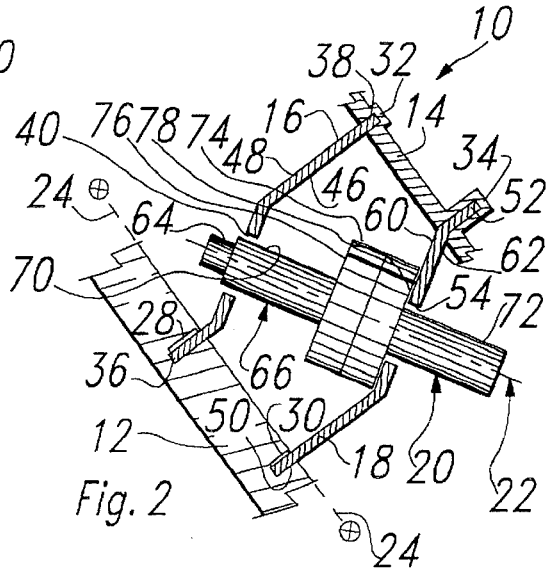
FIG. 2 shows the magnetic apparatus of FIG. 1 inclined to a different gravitational orientation so that the magnetic apparatus is in an open position.

Referring to FIG. 2, magnetic member 20 has a magnet 64 (partially visible in FIG. 2, see FIG. 5 for phantom detail), a case 66 partially enveloping magnet 64, and a weight 68 (shown in phantom in FIG. 5). Magnet 64 and weight 68 are separately secured to case 66. Magnet member 20 also includes a first end 70 and a second end 72. Slide axis 22 runs through first aperture 40 and second aperture 54.

In the preferred embodiment weight 68 weighs about eleven grams. Magnet 64 is preferably a conventional cylindrical magnet such as the cast ALNICO 5, Permag PR400. Case 66 is made of a material which slides well on first magnet guide 16 and second magnet guide 18. In the preferred embodiment, nylon 6/6 loaded with 20% TPFE, is used for case 66 material and Delrin, Fulton 404 is used for first magnet guide 16 and second magnet guide 18.

Case 66 includes a stopping member 74 disposed between first end 70 and second end 72. Stopping member 74 has a first stopping surface 76 and a second stopping surface 78. First stopping surface 76 presents a first stopping surface diameter 80 (see FIG. 6) which is greater than first aperture diameter 42 (see FIG. 5). Second stopping surface 78 presents a second stopping surface diameter 82 (see FIG. 6) which is greater than second aperture diameter 56 (see FIG. 5).

Referring to FIG. 3, a magnetic assembly 84 is illustrated in an exploded view including apparatus 10 and a three-dimensional, field-actuated reed switch 86. Changing apparatus 10 from the closed position to the open position (or vice versa) magnetically toggles reed switch 86 by changing the relative proximity of magnet 64 thereto.

Reed switch 86 includes an insulating body 88, a first lead 90 and a second lead 92. Leads 90,92 are partially contained in body 88 (those portions being shown in phantom). In the preferred embodiment, reed switch 86 is a single-pole, single-throw switch and relatively small, such as model MDRR4 available from Hamlin Incorporated of Lake Mills, Wis.

Preferably, body 88 is made of glass and leads 90, 92 are hermetically sealed therein in an inert atmosphere. First lead 90 has a terminal end 94 and a contact end 96. Terminal end 94 is in electrical contact with a first terminal 98 of an electrical circuit 100 (See FIG. 11). Contact end 96 preferably includes a low-reluctance ferro-magnetic blade.

Second lead 92 has a terminal end 102 and a contact end 104. Terminal end 102 is in electrical contact with a second terminal 106 of electrical circuit 100 (See FIG. 11). Contact end 104 preferably includes a low-reluctance ferro-magnetic blade. Contact end 96 overlaps contact end 104. In the open position of reed switch 86, contact ends 96, 104 don't make physical contact (reed switch 86 is shown in the open position in FIG. 3). In the closed position of reed switch 86, contact ends 96, 104 do make physical (and thus electrical) contact.

Figure 7:
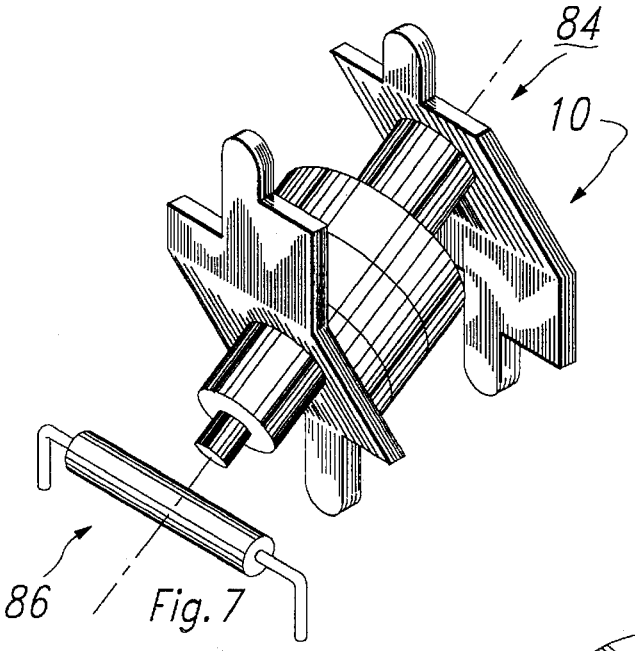
FIG. 7 is a partial perspective view of the assembly of FIG. 3.

FIG. 7 shows assembly 84 in perspective with bottom plate 12 and top plate 14 of apparatus 10 omitted for clarity of illustration.

Figure 8:
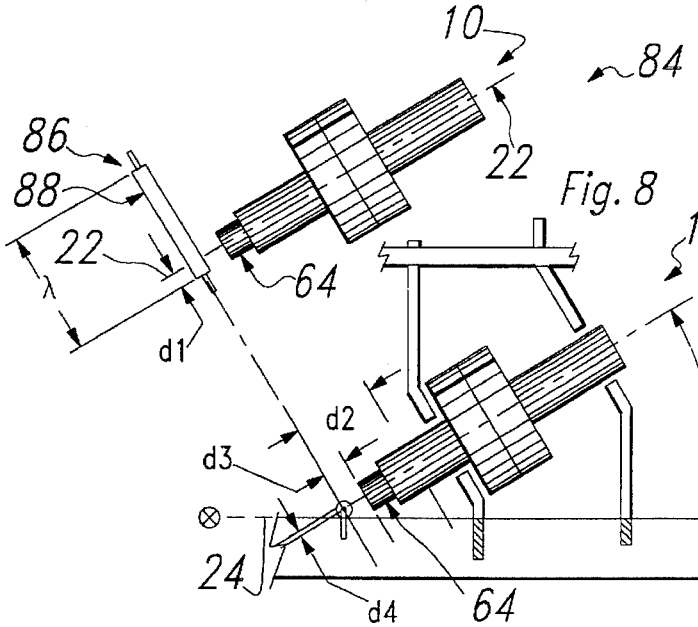
FIG. 8 is a partial plan view of the assembly of FIG. 3 illustrating certain geometrical relationships.

FIG. 8 is an oblique plan view of assembly 84 (again with bottom plate 12, top plate 14, as well as first magnet guide 16 and second magnet guide 18 omitted for clarity of illustration). FIG. 8 illustrates the preferred orientation of magnet 64 and slide axis 22 with respect to body 88 of reed switch 86. Slide axis 22 is projected through body 88 to define a dimension d1, as indicated by the arrows, relative to the bottom end (as viewed in FIG. 8) of body 88. Body 88 also presents a length 1 as indicated by the arrows. The preferred ratio of dimension d1 to length 1 is about one to four. In the preferred embodiment, length 1 is about 0.6 inches and thus dimension d1 is about 0.15 inches.

Figure 9:
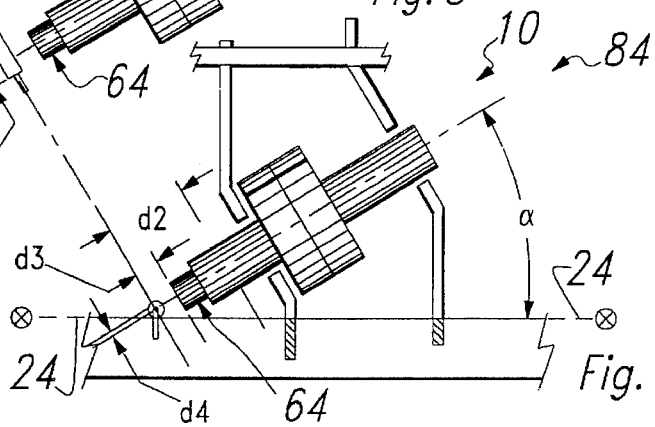
FIG. 9 is an elevational view of the assembly of FIG. 3 further detailing certain geometrical relationships.

FIG. 9 is a side view illustrating other dimensional characteristics of assembly 84. Body 88 presents a radius d4. In the preferred embodiment, d4 is about 0.105 inches. Dimension d3 is the distance between the axial center of body 88 and the tip of magnet 64 when apparatus 10 is in the closed position. In the preferred embodiment dimension d3 is about 0.110 plus or minus 0.010 inches. Dimension d2 is the distance between the axial center of body 88 and the tip of magnet 64 when apparatus 10 is in the open position. Dimension d2 is about 0.450 inches, minimum. Also shown in FIG. 9 is angle alpha, defined as the angle between slide axis 22 and gravity reference plane 24. In the preferred embodiment angle alpha is about twenty-five degrees.

FIG. 4 is a plan view of a sensing mechanism or array 108. Five assemblies 84 are the preferred number for this design but other numbers of assemblies 84 can be used to adapt for a particular design application. Note bottom plate 12 is shared by each assembly 84 and that top plate 14 and magnet guides 16, 18 are omitted for clarity of illustration. One common top plate 14 is shared by each assembly 84 in the preferred embodiment, as with bottom plate 12, but in an alternative embodiment each assembly 84 could have its own individual top plate.

Gravity reference plane 24 (not explicitly shown in FIG. 4) is coplanar with the visible surface of bottom plate 12 as shown in FIG. 4, with gravity line 26 indicated as going into the plane of the page and perpendicular to gravity reference plane 24 (i.e. gravity reference plane 24 is parallel to the ground in this orientation and array 108 is in an upright position, with each apparatus 10 in a closed position). It will be readily appreciated that by changing the orientation of gravity reference plane 24 of array 108 in three dimensional space with respect to gravity line 26, any combination of closed and open positions of apparatus 10 of assemblies 84 can be achieved. The total number of such combinations is thirty-two (i.e. $2^5$).

Figure 10:
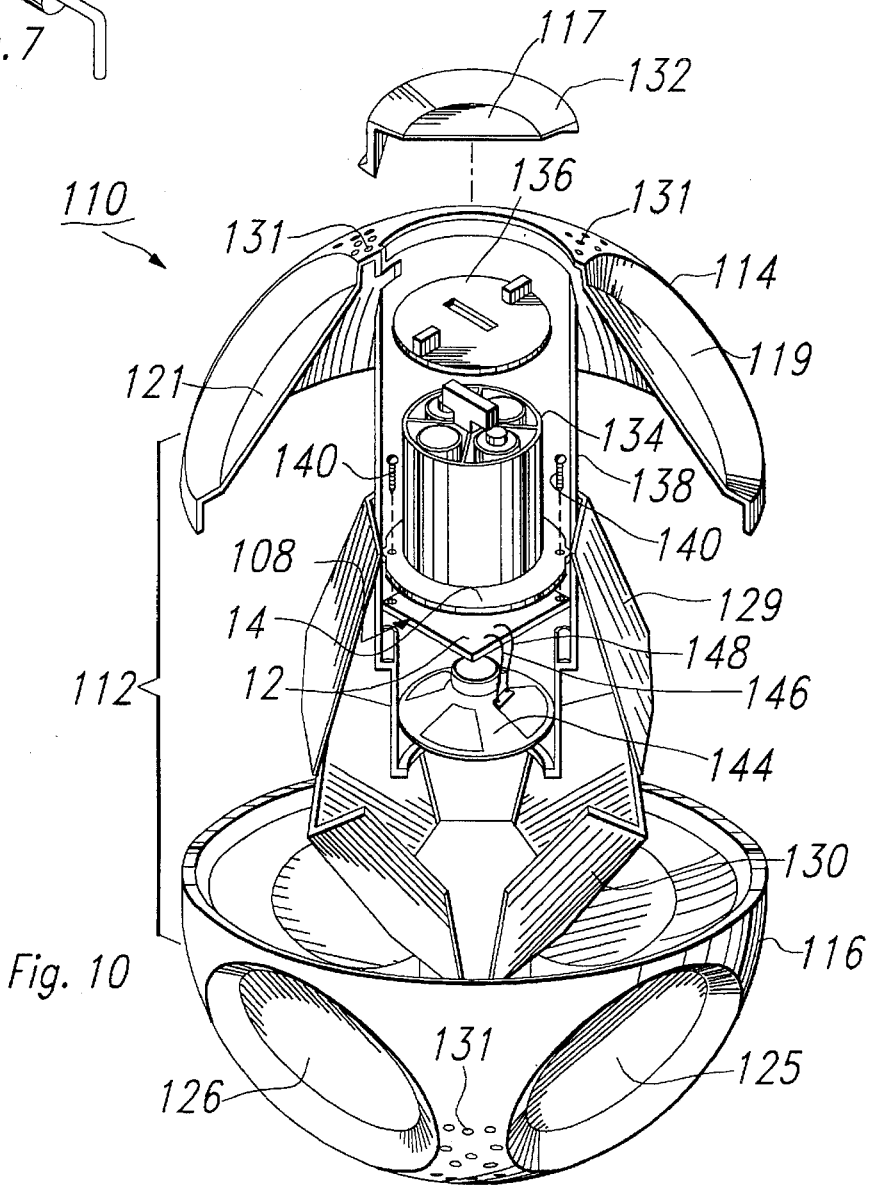
FIG. 10 is an exploded view of an electronic system incorporating an array of assemblies as illustrated in FIG. 4.

Referring to FIG. 10, an exploded perspective view of a toy or system incorporating array 108 and constructed in accordance with the present invention is generally identified by reference numeral 110. Array 108 could be utilized in other types of systems, nonrecreational as well as recreational in function, as will be readily appreciated by those skilled in the art. Indeed any application wherein a gravity sensing array 108 or the like is useful is within the scope of the invention.

System 110 includes a container or frame 112, having first and second halves 114 and 116. Frame 112 preferably includes a twelve-sided polygon or dodecahedron having twelve planar faces 117–128 (only 117, 119, 121, 125 and 126 are shown in FIG. 10). Faces 117–128 are provided with indicia or a visual display which corresponds with a sound and/or voice produced by a microprocessor as will subsequently be described in greater detail.

For example, system 110 is provided with a first insert 129 and a second insert 130, which are preferably, for example, animal displays (not shown) on each of the planar faces 117–128. Inserts 129 and 130 make it relatively simple to replace the visual displays and still use the same frame 12. Of course the faces 117–128 are transparent when inserts are used. Alternatively, it is possible to provide visual displays that are connected directly to a surface of planar faces 117–128.

Frame 112 is designed so that system 110 must come to rest with one of the planar faces 117–128 uppermost and parallel to the ground. Thus, in this embodiment only twelve of the thirty-two previously-mentioned combinations of open and closed positions can be attained. In FIG. 10 planar face 117 is uppermost.

Frame 112 is constructed with a plastic material that is non-toxic and safe for the use of infants. First and second halves 114, 116 are molded to have smooth or rounded edges rather than sharp edges to facilitate rolling of system 110 onto its various faces 117–128. First and second halves 114, 116 may be secured together by any appropriate method such as sonic welding, gluing or fastening with screws. First and second halves 114 and 116 are provided with a plurality of frame apertures 131 to facilitate the transmission of sound therethrough.

Access to the interior of frame 112 is through a removable cap 132 which is coincident with face 117 and is preferably constructed to deny access except by prying with a screwdriver or coin or the like. Within frame 112 is a battery pack 134, which may contain for example, four AA batteries to provide power for system 110. A cover 136 may be provided for battery pack 134 to allow for an on/off switch. Battery pack 134 is secured to an inner support 138 by any appropriate method such as screws 140, which also connect top plate 14 to bottom plate 12.

Secured to inner support 138 adjacent battery pack 134 is PCB or bottom plate 12, which further includes electrical circuit 100 incorporating a microprocessor 142 (see FIG. 11) necessary to enable system 110 to function, as will be subsequently described in greater detail. Opposite removable cap 132 and within frame 112 is a speaker 144. Speaker 144 is interconnected to PCB 12 via electrical connections 146 and 148, which enable speaker 144 to respond to microprocessor 142. Position sensing mechanism or array 108 (see also FIG. 4) is generally indicated but the remaining portions of array 108 disposed between bottom plate 12 and top plate 14 (i.e. five assemblies 84) are not visible from the angle as shown in FIG. 10. Array 108 is mounted in relation to PCB 12 to allow microprocessor 142 to determine which of the planar faces 117–128 of system 110 is in a predetermined orientation or the "up" position (i.e. face 117 in FIG. 1), in which one of faces 117–128 is uppermost.

In operation, and referring to FIG. 5, as array 108 ( only one assembly 84 of which is shown in FIG. 5) is moved in three dimensional space such that gravity reference plane 24 is altered with respect to gravity line 26, each assembly 84 is gravitationally affected. The rays depicted in FIG. 5 illustrate a range of angles through which slide axis 22 can be moved and still keep apparatus 10 in the closed position. Note that slide axis 22 is extended to the left past the substantially semispherical plurality of rays to indicate that slide axis 22 as shown in FIG. 5 is substantially oriented about midway in the range of orientations associated with the closed position. Note also that an eight degree range of angles is indicated on the upper limit of the range and the lower limit of the range. This is to indicate that there is about an eight degree subrange at the limits wherein it is somewhat indeterminate whether magnet 64 will actually shift from the closed position to the open position. Parameters affecting where in this eight degree range magnet 64 will actually shift include the coefficient of static friction between cover case 66 and first magnet guide 16 and second magnet guide 18 respectively, as well as the total weight of magnetic member 20.

Figure 6:
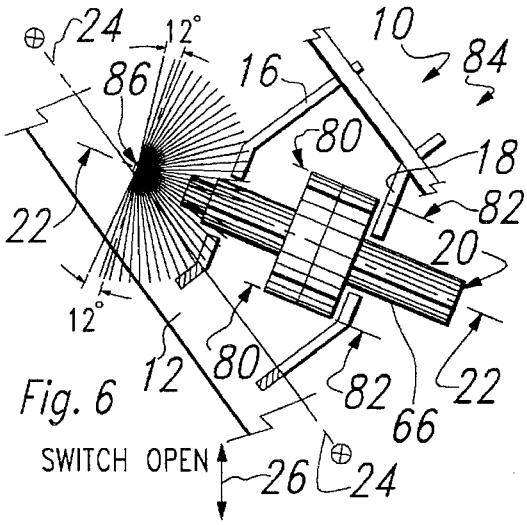
FIG. 6 shows the assembly of FIG. 3 inclined to a different gravitational orientation, and a substantially semispherical range of angles over which the magnetic apparatus is in an open position.

Likewise in FIG. 6, when gravity reference plane 24 is positioned with respect to gravity line 26 such that magnet member 20 (and thus magnet 64) slides to the open position, there is a range of orientations of slide axis 22 which will maintain that open position. Once again slide axis 22 has been extended to the left through reed switch 86. A substantially semispherical plurality of rays are configured to show the angles to which the slide axis can be adjusted and still maintain the open position. The extension of slide axis to the left visually indicates that the configuration of slide axis 22 as depicted in FIG. 6 is substantially about midway in the range of orientations corresponding to the open position. Note the twelve degree subranges indicated at the limits of the range of rays. As discussed above with respect to the transition from closed position to open position, analogously there is about a twelve degree subrange for the change from the open position to the closed position. Once again the parameters that determine exactly where within this twelve degree subrange magnet member 20 shifts from the open position to the closed position will include the static coefficient of static friction between case 66 and first magnet guide 16 and second magnet guide 18 respectively, as well as the weight of magnetic member 20.

Referring once again to FIG. 10, when system 110 is moved, it immediately turns on and begins playing musical notes while being rolled or turned. If a child stops turning or rolling the ball, a pleasant voice will announce the identification of and a sound corresponding to the visual display or indicia on whichever planar face 117–128 which is in the "up" position. For example, using the following visual display arrangement:

| | |
|---|---|
| face 117 = a dog; | face 123 = a horse; |
| face 118 = a cat; | face 124 = an owl; |
| face 119 = a duck; | face 125 = a sheep; |
| face 120 = a cow; | face 126 = a frog; |
| face 121 = a goose; | face 127 = a chicken; and |
| face 122 = a pig; | face 128 = a bird. |

If face 119 having a duck picture is in the "up" position, the system 108 will state that a duck is shown followed by a representative sound of a duck. Continuing the example, if face 122 having a pig picture is turned to the "up" position, system 108 will state that a pig is shown followed by a representative sound of a pig, and so on.

When system 110 is moved again, musical notes play until another visual display is recognized in the "up" position by a pause in motion. As long as the system 110 is rolled or turned, it will continue to respond with an identification and representative sound of the visual display in the "up" position. When the toy 110 is not turned or rolled for a brief period, a short musical signal will play to re-attract the child's attention. If there is no further activity, the system 110 will announce that it is being turned off, which will then automatically occur.

Figure 11:
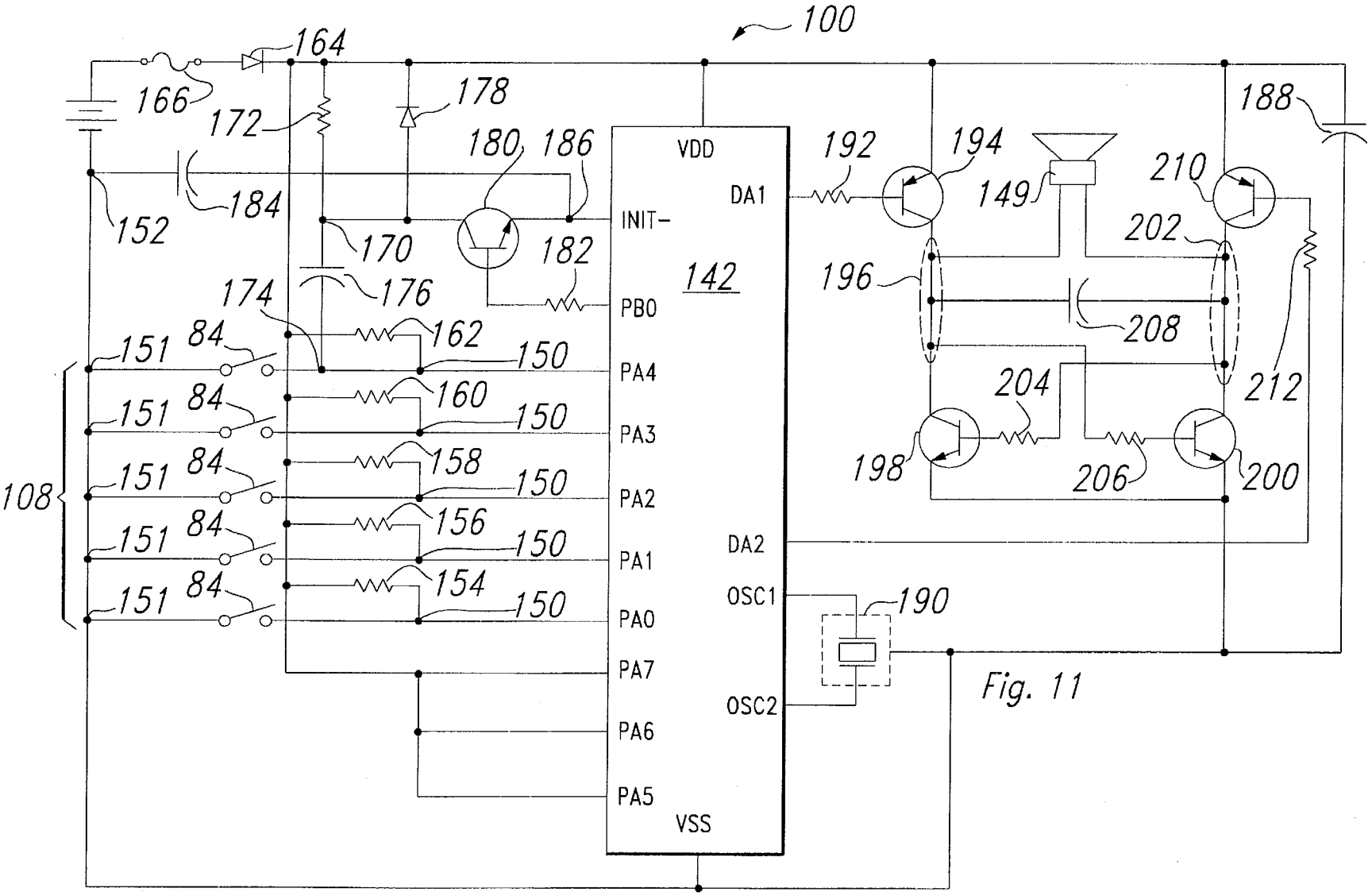
FIG. 11 is an electrical schematic for the system of FIG. 10.

Referring to FIG. 11, an electrical schematic illustrating circuit 100 including microprocessor 142 is depicted. Circuit 100 is used to convert the output of array 108 into an aural response through speaker 144. As shown in FIG. 11, array 108 corresponds to the five assemblies 84 as discussed above. The five assemblies 84 correspond to five planes of a dodecahedron as will be subsequently described in greater detail.

Microprocessor 142 is connected to assemblies 84 by pins PAO, PA1, PA2, PA3, and PA4, respectively. Each node 150 represents the point where terminal end 94 (FIG. 3) comes in contact with first terminal 98 (FIG. 3) of electrical circuit 100, for each respective reed switch 86. Each node 151 represents the point where terminal end 102 (FIG. 3) comes in contact with second terminal 106 (FIG. 3) of electrical circuit 100, for each respective reed switch 86. The five nodes 151 are connected to a node 152 also connected to the low side of battery pack 134.

Microprocessor 142 is preferably capable of decoding at least twelve lines of the encoded data, storing multiple sounds, selecting one of the stored sounds corresponding to a decoding signal and generating an audible sound in response to the decoded signal. The audible sound is preferably of an educational nature corresponding to a visual display on the planar faces 117–128 (See FIG. 10). In the preferred system 110, the audible sounds mimic human speech or animal vocalizations, or both.

Pull-up resistors 154, 156, 158, 160 and 162 are connected to pins PA0-PA4 and the five assemblies 84, respectively. Resistors 154–162 are preferably on the order of 200 ohms and are also connected to the cathode of a diode 164. The anode of diode 164 is connected to a fuse 166, which is connected to battery pack 134. Battery pack 134 provides six volts in the preferred embodiment. Fuse 166 protects circuit 100 from shorts and diode 164 prevents reverse battery damage.

Between a node 168 and a node 170 is a resistor 172 which may be on the order of 200 ohms. Between node 170 and a node 174 is a capacitor 176 which may be on the order of 12,000 picofarads. Node 170 is connected to the anode of a diode 178 with the cathode of diode 178 connected to node 168. The collector of a transistor 180, which preferably is of the pnp type, is also connected to the anode of diode 178. The emitter of transistor 180 is connected to microprocessor 142 at inverse INIT. The base of transistor 180 is connected through a resistor 182, which is preferably on the order of eighty-two ohms, to microprocessor 142 at PBO. A capacitor 184 which is preferably on the order of 2200 picofarads is connected between a node 186 and node 152.

Microprocessor 142 is powered by battery back 134 through $V_{DD}$ and $V_{SS}$. A capacitor 188 which is preferably on the order of forty-seven picofarads is installed between node 168 and node 152. A ceramic resonator 190 provides the clock to run microprocessor 142 through OSC1 and OSC2. Pins PA5–PA7 of microprocessor 142 are all coupled together and connected to the cathode of diode 164.

Speech output is transmitted to speaker 144 through pins DA1 and DA2. Pin DA1 is connected through a resistor 192 which is preferably on the order of 560 ohms, to the base of a transistor 194 which is preferably of the pnp type. The emitter of transistor 194 is connected to node 168, while the collector of transistor 194 is connected to a node 196. The collector of a transistor 198, which is preferably of the npn type, is connected to node 196. The emitter of transistor 198 is connected to the emitter of a transistor 200 (also preferably of the npn type) and to node 152. The base of transistor 198 is connected to a node 202 through a resistor 204 which is preferably on the order of 100 ohms. the collector of transistor 200 is connected to node 202 while the base of transistor 200 is connected to node 196 through a resistor 206, which is preferably on the order of 100 ohms.

Connected between nodes 196 and 202 is a capacitor 208 which is preferably on the order of ten microfarads. Also connected between nodes 196 and 202 is speaker 144 which is preferably on the order of eight ohms. The emitter of a transistor 210, which is preferably of the pnp type, is connected to node 168, while the collector of transistor 210 is connected to node 202. The base of transistor 210 is connected to the output DA2 of microprocessor 142 through a resistor 212, which is preferably on the order of 560 ohms. The four transistors 194, 198, 200 and 210 form an amplifier for speaker 144 and capacitor 208 provides a filter.

In operation, when schematically topmost assembly 84 is actuated, the initialization circuit including resistor 172, capacitor 176, diode 178, transistor 180, resistor 182, and capacitor 184 activate microprocessor 142 to play a musical tune. When topmost assembly 84 goes from the open to the closed position, a negative voltage spike occurs through capacitor 176. If system 110 is powered down, the negative spike will go through transistor 180 and trigger the inverse INIT causing microprocessor 142 to turn on. If microprocessor 142 is already on, the transistor 180 will be off and the negative trigger will not reach microprocessor 142. Capacitor 184 is present to prevent noise from causing an interrupt to microprocessor 142. As various of the five assemblies 84 are activated, microprocessor 142 interprets the code provided thereto and transmits the appropriate aural response to speaker 144. After a set period of time, when none of the five assemblies 84 are actuated, the circuit will automatically shut down after a warning.

It would also be possible to place a software option in the microprocessor 142 to automate a quiet mode rather than a mechanical on/off switch. Such an option could provide a specific sequence of repositioning system 110 (such as turning back-and-forth from a picture of an owl to a picture of a cow three times) to turn the system 110 off until the sequence is reversed (or another sequence is initiated). This would allow an adult to shut system 110 off and leave it with a sleeping infant without fear of accidentally turning system 110 on. In more detail, as toy 110 is positioned on its various planar faces 117–128, each magnet 64 slides toward or away from reed switch 86. When magnet 64 is proximate reed switch 86, a signal is sent through node 150 to microprocessor 142 indicating a closed circuit for that respective assembly 84. When magnet 64 slides away from reed switch 86, an open circuit response is provided to microprocessor 142.

Since there are five assemblies 84, there is a possibility of thirty-two combinations of signals to be sent to microprocessor 142, of which only twelve are active, as previously mentioned. If toy 110 were designed to present visual displays of animals, a possible sequence of coded signals would be as follows:

| Assemblies 84 in descending order as viewed in FIG. 11. | | | | | |
|---|---|---|---|---|---|
| Topmost | | | | Bottommost | |
| 84 | 84 | 84 | 84 | 84 | 1 = open<br>0 = closed |
| 0 | 0 | 0 | 0 | 0 | Face 117 Dog |
| 0 | 0 | 0 | 0 | 1 | — |
| 0 | 0 | 0 | 1 | 0 | — |
| 0 | 0 | 0 | 1 | 1 | Face 121 Goose |
| 0 | 0 | 1 | 0 | 0 | — |
| 0 | 0 | 1 | 0 | 1 | — |
| 0 | 0 | 1 | 1 | 0 | Face 122 Pig |
| 0 | 0 | 1 | 1 | 1 | Face 124 Owl |
| 0 | 1 | 0 | 0 | 0 | — |
| 0 | 1 | 0 | 0 | 1 | — |
| 0 | 1 | 0 | 1 | 0 | — |
| 0 | 1 | 0 | 1 | 1 | — |
| 0 | 1 | 1 | 0 | 0 | Face 118 Cat |
| 0 | 1 | 1 | 0 | 1 | — |
| 0 | 1 | 1 | 1 | 0 | Face 123 Horse |
| 0 | 1 | 1 | 1 | 1 | — |
| 1 | 0 | 0 | 0 | 1 | — |
| 1 | 0 | 0 | 0 | 1 | Face 120 Cow |
| 1 | 0 | 0 | 1 | 0 | — |
| 1 | 0 | 0 | 1 | 1 | Face 125 Sheep |
| 1 | 0 | 1 | 0 | 0 | — |
| 1 | 0 | 1 | 0 | 1 | — |
| 1 | 0 | 1 | 1 | 0 | — |
| 1 | 0 | 1 | 1 | 1 | — |
| 1 | 1 | 0 | 0 | 0 | Face 119 Duck |
| 1 | 1 | 0 | 0 | 1 | Face 126 Frog |
| 1 | 1 | 0 | 1 | 0 | — |
| 1 | 1 | 0 | 1 | 1 | — |
| 1 | 1 | 1 | 0 | 0 | Face 127 Chicken |
| 1 | 1 | 1 | 0 | 1 | — |
| 1 | 1 | 1 | 1 | 0 | — |
| 1 | 1 | 1 | 1 | 1 | Face 128 Bird |

Using the above decoding table, microprocessor 142 will be able to determine which planar surface 117–128 is in the "up" position, and the correct aural response will be produced.

Thus system 110 provides an array 108 of assemblies 84 each assembly 84 featuring a magnetic apparatus 10 having the environmental and safety benefits described above. In addition the construction is rugged, versatile and gravitationally sensitive while each individual magnetic apparatus is also nonenclosed (and thus less susceptible to moisture and contamination than an enclosed apparatus would be). In addition each magnetic apparatus 10 is of a small enough scale so that array 108 is compact and easily adapted to many different applications beyond the type of system 110 described herein.

Although the invention has been described in detail herein with reference to its preferred embodiment and certain described alternatives, it is to be understood that this description is by way of example only, and is not to be construed in a limiting sense. It is to be further understood that numerous changes in the details of the embodiments of the invention, and additional embodiments of the invention, will be apparent to, and may be made by, persons of ordinary skill in the art having reference to this description. It is contemplated that all such changes and additional embodiments are within the spirit and true scope of the invention as claimed below.

What is claimed is:

1. A magnetic apparatus for activating a switch, the magnetic apparatus comprising:

a bottom plate presenting a gravity reference plane;

a first magnet guide supported by the bottom plate in an upright position with respect to the gravity reference plane, the first magnet guide having a first aperture presenting a first aperture plane defining an oblique angle with respect to the gravity reference plane;

a second magnet guide supported by the bottom plate in an upright position with respect to the gravity reference plane, the second magnet guide having a second aperture presenting a second aperture plane defining an oblique angle with respect to the gravity reference plane; and a magnet member including a magnet, the magnet member supported by the first magnet guide and the second magnet guide, the magnet member presenting a slide axis running through the first aperture and the second aperture, the magnet member including a first end and a second end, the first end received in the first aperture, the second end received in the second aperture.

2. The magnetic apparatus of claim 1, wherein the first aperture presents a first aperture diameter, the second aperture presents a second aperture diameter, and the magnet member includes a stopping member disposed between the first end and the second end, the stopping member having a first stopping surface and a second stopping surface, the first stopping surface disposed closer to the first aperture and the second stopping surface disposed closer to the second aperture, the first stopping surface presenting a first stopping surface diameter which is greater than the first aperture diameter, and the second stopping surface presenting a second stopping surface diameter which is greater than the second aperture diameter, such that when the magnet is shifted to the closed position, the first stopping surface abuts the first magnet guide, and when the magnet is shifted to the open position the second stopping surface abuts the second magnet guide.

3. The magnetic apparatus of claim 2, wherein the magnet member includes a case partially enveloping the magnet, and the stopping member is formed on the case.

4. The magnetic apparatus of claim 1, wherein the magnet member includes a weight secured to the magnet.

5. The magnetic apparatus of claim 1, wherein the bottom plate comprises a printed circuit board.

6. The magnetic apparatus of claim 1, wherein a first bottom slot and a second bottom slot are formed in the bottom plate, the first magnet guide has a bottom tab formed thereon, the second magnet guide has a bottom tab formed thereon, the bottom tab of the first magnet guide matingly received in the first bottom slot, and the bottom tab of the second magnet guide matingly received in the second bottom slot.

7. The magnetic apparatus of claim 1, further including a top plate secured to the first and second magnet guides.

8. The magnetic apparatus of claim 7, wherein a first top slot and a second top slot are formed in the top plate, and the first magnet guide has a top tab formed thereon, the second magnet guide has a top tab formed thereon, the top tab of the first magnet guide matingly received in the first top slot, and the top tab of the second magnet guide matingly received in the second top slot.

9. A magnetic assembly for toggling an electrical circuit having a first terminal and a second terminal, the magnetic assembly comprising:

a bottom plate presenting a gravity reference plane;

a first magnet guide supported by the bottom plate in an upright position with respect to the gravity reference plane, the first magnet guide having a first aperture presenting a first aperture plane defining an oblique angle with respect to the gravity reference plane;

a second magnet guide supported by the bottom plate in an upright position with respect to the gravity reference plane, the second magnet guide having a second aperture presenting a second aperture plane defining an oblique angle with respect to the gravity reference plane;

a magnet member including a magnet, the magnet member supported by the first magnet guide and the second magnet guide above the gravity reference plane, the magnet member presenting a slide axis running through the first aperture and the second aperture, the magnet member including a first end and a second end, the first end received in the first aperture, the second end received in the second aperture; and a magnetic field-activated reed switch mounted adjacent the bottom plate and proximal the first magnet guide, the reed switch including an insulating body containing a first lead having a contact end and a second lead having a contact end, the respective contact ends of the first and second leads normally forming a gap therebetween, the first lead further having a terminal end in electrical contact with the first terminal of the electrical circuit and the second lead further having a terminal end in electrical contact with the second terminal of the electrical circuit whereby when the magnet is placed in the closed position, the respective contact ends of the first lead and second lead make electrical contact and toggle the electrical circuit.

10. The magnetic assembly of claim 9, wherein the magnet member includes a weight secured to the magnet.

11. A gravity-sensitive electronic system comprising:

a frame suitable for more than one gravitational orientation with respect to the surface of the earth;

an electrical circuit having a first terminal and a second terminal, the electrical circuit including structure for generating a signal;

an array operatively associated with the frame, the array having at least one magnetic assembly, including a bottom plate presenting a gravity reference plane, a first magnet guide supported by the bottom plate in an upright position with respect to the gravity reference plane, the first magnet guide having a first aperture presenting a first aperture plane defining an oblique angle with respect to the gravity reference plane, a second magnet guide supported by the bottom plate in an upright position with respect to the gravity reference plane, the second magnet guide having a second aperture presenting a second aperture plane defining an oblique angle with respect to the gravity reference plane, a magnet member including a magnet, the magnet member supported by the first magnet guide and the second magnet guide above the gravity reference plane, the magnet member presenting a slide axis running through the first aperture and the second aperture, the magnet member including a first end and a second end, the first end received in the first aperture, the second end received in the second aperture, and a magnetic field-activated reed switch mounted adjacent the bottom plate and proximal the first magnet guide, the reed switch including an insulating body containing a first lead having a contact end and a second lead having a contact end, the respective contact ends of the first and second leads normally forming a gap therebetween, the first lead further having a terminal end in electrical contact with the first terminal of the electrical circuit and the second lead further having a terminal end in electrical contact with the second terminal of the electrical circuit such that when the magnet is oriented to place the magnet in the closed position the respective contact ends of the first lead and second lead make electrical contact and toggle the electrical circuit, so that the electrical circuit generates a signal; and the electrical circuit further including a logic element, wherein said logic element is electrically connected to each respective magnetic assembly of the array.

12. The electronic system of claim 11, wherein each magnetic assembly commonly shares the bottom plate.

13. The electronic system of claim 12, wherein the frame is a dodecahedron.

14. The electronic system of claim 11, wherein the logic element includes a microprocessor.

15. The electronic system of claim 11, wherein the logic element includes an output amplifier suitable for generating audible human speech as part of the output signal.

16. The electronic system of claim 11, wherein the frame is polygonal so as to present more than one side on the exterior of the system, at least one of the sides including indicia thereon.

17. The electronic system of claim 11, wherein the logic element includes an output amplifier suitable for generating audible human speech or animal vocalization as part of the output signal and wherein the frame is polygonal so as to present more than one side on the exterior of the system, each one of the sides including indicia thereon, such that when the frame is situated in one particular gravitational orientation the indicia for one side are orthogonally visible from above the system, and the logic element generates the output signal including the audible human speech or animal vocalization appropriate to that gravitational orientation, whereby the audible sound intelligibly corresponds to the indicia orthogonally visible from above the system.

18. A gravity-sensitive structure comprising:

a housing having a plurality of regions at least partially defining the outer surface thereof and adapted to be placed in a plurality of gravitational orientations respectively corresponding to each of the regions being disposed on a horizontal support surface;

an electrical circuit having a first terminal and a second terminal spaced from each other to provide an interruption in the electrical circuit; and a position-sensing mechanism disposed within said housing and including a plurality of position-sensing devices disposed in angular relationship with respect to each other;

each of said plurality of position-sensing devices comprising a magnetic assembly which includes a bottom plate presenting a gravity reference plane, a first magnet guide supported by the bottom plate in an upright position with respect to the gravity reference plane, the first magnet guide having a first aperture presenting a first aperture plane defining an oblique angle with respect to the gravity reference plane, a second magnet guide supported by the bottom plate in an upright position with respect to the gravity reference plane, the second magnet guide having a second aperture presenting a second aperture plane defining an oblique angle with respect to the gravity reference plane, a magnet member including a magnet, the magnet member supported by the first magnet guide and the second magnet guide above the gravity reference plane, the magnet member presenting a slide axis running through the first aperture and the second aperture, the magnet member including a first end and a second end, the first end received in the first aperture, the second end received in the second aperture, and a magnetic field-activated reed switch mounted adjacent to the bottom plate and proximate to the first magnet guide, the reed switch including an insulating body containing a first lead having a contact end and a second lead having a contact end, the respective contact ends of the first and second leads normally forming a gap therebetween when said magnet is disposed in the open position, the first lead further having a terminal end in electrical contact with the first terminal of said electrical circuit and the second lead further having a terminal end in electrical contact with the second terminal of said electrical circuit such that when the magnet is oriented to place the magnet in the closed position the respective contact ends of the first lead and the second lead make electrical contact in response to the magnetic field from the magnet to complete said electrical circuit.

19. The structure of claim 18 wherein said plurality of regions at least partially defining the outer surface comprise flat regions.

20. A magnetic apparatus comprising:

a bottom plate presenting a reference plane;

first and second magnet guides abutting said bottom plate and spaced from each other; and a magnet member movably supported by said first and second magnet guides and spaced above said bottom plate such that said magnet member is disposed along a guide plane, for movement between a first and a second position along said guide plane wherein said guide plane is at an oblique angle with respect to said reference plane.

21. The apparatus of claim 20 wherein said magnet member includes a magnet and a weight.

22. The apparatus of claim 20 wherein said bottom plate comprises a non-conductive material.

23. The apparatus of claim 20 wherein said first and second magnet guides each include an aperture, said magnet member extending through each of said apertures in said first and second magnet guides.

24. The apparatus of claim 23 wherein said magnet member includes a stopping member, said stopping member having a first stopping surface with a diameter which is greater than the diameter of the aperture within said first magnet guide, said stopping member further having a second stopping surface with a diameter which is greater than the diameter of the aperture within the second magnet guide.

25. The apparatus of claim 24 wherein said stopping member contains a weight.

* * * * *